US005231927A

United States Patent [19]

Pfisterer et al.

[11] Patent Number: 5,231,927

[45] Date of Patent: Aug. 3, 1993

[54] ELECTRIC OR ELECTRONIC SHEET CONTROL DEVICE FOR SHEET-TRANSFERRING CYLINDERS OF PRINTING MACHINES

[75] Inventors: Alexander Pfisterer, Eppelheim; Andreas Schulz, Heidelberg, both of Fed. Rep. of Germany

[73] Assignee: Heidelberger Druckmaschinen AG, Heidelberg, Fed. Rep. of Germany

[21] Appl. No.: 874,535

[22] Filed: Apr. 27, 1992

[30] Foreign Application Priority Data

Apr. 25, 1991 [DE] Fed. Rep. of Germany ..... 4113478

[51] Int. Cl.[5] ..... B41F 21/10; B65H 5/08

[52] U.S. Cl. ..... 101/409; 271/227; 271/277

[58] Field of Search ..... 101/246, 408, 409, 410, 101/411, 412; 271/227, 228, 259, 261, 275, 277

[56] References Cited

U.S. PATENT DOCUMENTS

| | | | |
|---|---|---|---|
| 3,595,567 | 7/1971 | Lee et al. | 271/261 |
| 3,926,118 | 12/1975 | Preuss | 101/409 |
| 3,948,170 | 4/1976 | Ericsson | 271/261 |
| 4,127,265 | 11/1978 | Wirz et al. | 271/261 |
| 4,466,350 | 8/1984 | Schilling et al. | 101/411 |
| 4,785,733 | 11/1988 | Hartung et al. | 101/248 |
| 4,805,893 | 2/1989 | Kusaka | 101/408 |

FOREIGN PATENT DOCUMENTS

| | | | |
|---|---|---|---|
| 1561088 | 4/1971 | Fed. Rep. of Germany . | |
| 7700430 | 5/1978 | Fed. Rep. of Germany . | |
| 2322194 | 10/1982 | Fed. Rep. of Germany . | |
| 58-167340 | 10/1983 | Japan . | |
| 64450 | 4/1984 | Japan | 271/261 |
| 286543 | 11/1990 | Japan | 271/261 |
| 8648 | 1/1991 | Japan | 271/228 |
| 1392913 | 5/1975 | United Kingdom . | |

*Primary Examiner*—Edgar S. Burr
*Assistant Examiner*—Stephen R. Funk
*Attorney, Agent, or Firm*—Herbert L. Lerner; Laurence A. Greenberg

[57] ABSTRACT

An electric or electronic sheet control device is provided at a sheet-transferring cylinder of a printing machine. According to the state of the art, in order to detect a leading edge of a sheet, two detecting elements respectively detect the presence of a sheet and a misaligned sheet. According to the invention, two detecting elements are disposed in such a way that they detect at least the outer areas of a leading edge of a sheet and at least one further detecting element is provided between the two detecting elements, which makes it possible to detect whether or not the leading edge of the sheet is straight.

8 Claims, 1 Drawing Sheet

ELECTRIC OR ELECTRONIC SHEET CONTROL DEVICE FOR SHEET-TRANSFERRING CYLINDERS OF PRINTING MACHINES

BACKGROUND OF THE INVENTION

1. Field of the Invention

The invention relates to an electric or electronic sheet control device for sheet-transferring cylinders of printing machines, including detecting elements disposed on the cylinder in the area of a cylinder edge cooperating with the grippers, for detecting a leading edge of a sheet.

Such a sheet control device is known from German Petty Patent DE-GM 77 00 430. In that sheet control device, two detecting elements are disposed at a certain distance from each other in the area of the cylinder edge cooperating with the grippers, thus registering whether or not a sheet has been gripped and recognizing a misaligned sheet.

2. Description of the Related Art Including Information Disclosure Under 37 C.F.R. 1.97–1.99

However, the leading edge of the sheet may be curved when being taken by the grippers, as a result of an irregular sheet transport. In such a case, the leading edge of the sheet has a concave or convex shape because the lateral parts of the sheet are conveyed faster than the middle part thereof, or vice versa. The known sheet control device does not permit the detection of such a fault.

SUMMARY OF THE INVENTION

It is accordingly an object of the invention to provide an electric or electronic sheet control device for sheet-transferring cylinders of printing machines, which overcomes the hereinafore-mentioned disadvantages of the heretofore-known devices of this general type and which also detects whether or not a leading edge of the sheet is straight.

With the foregoing and other objects in view there is provided, in accordance with the invention, in a printing machine having a sheet-transferring cylinder with grippers and a cylinder edge cooperating with the grippers, an electric or electronic sheet control device for the sheet-transferring cylinder, comprising two detecting elements disposed on the cylinder in the vicinity of the cylinder edge for detecting outer areas of a leading edge of a sheet, and at least one further detecting element disposed between the two detecting elements.

The possibility of detecting whether or not the leading edge of a print sheet is straight and held parallel to the cylinder axis by the gripper system, constitutes the advantage of the invention. Misaligned sheets are properly aligned in a known manner. Moreover, it is also possible to appropriately correct concave or convex leading edges of print sheets by varying one or more printing parameters (ink, pressure etc). The sheet control device makes it possible to detect the leading edge of the sheet in the gripper system of each printing unit of the printing machine. During the machine run the continuous checking permits the recognition of changes in the position of a print sheet in the gripper system which are caused by speed variations or by the transfer from one cylinder to the other.

In accordance with another feature of the invention, the at least one further detecting element is disposed substantially in the middle of the leading edge of the sheet. In general, it is sufficient to provide two detecting elements for the outer areas of the leading edge of the sheet and a further detecting element for detecting the middle of the leading edge of the sheet.

Since the leading edge of the sheet is only slightly curved, which is nevertheless essential for the print quality, it is important that the detecting elements be able to detect minimal deviations of the leading edge of the sheet from its desired position. For this purpose, in accordance with a further feature of the invention, the detecting elements are CCD-row arrays.

An advantage of the use of CCD-row arrays is that they detect a sheet edge with an accuracy of 1/100 mm. This accuracy also suffices to detect a curvature of the leading edge of the sheet. In accordance with an added feature of the invention, the grippers have holding surfaces, the cylinder edge cooperating with the gripper has corresponding surfaces, and there are provided light sources, the CCD-row arrays and the light sources being disposed at the holding surfaces of the grippers and at the corresponding surfaces.

Either the CCD-row array is integrated in a gripper in the vicinity of the gripper surface and the light source is positioned at the corresponding surface of the cylinder edge cooperating with the gripper, or vice versa. A special advantage of this embodiment is that the leading edge of the sheet is positioned between the CCD-row array and the light source in such a way that the transmitter and the receiver are disposed at the least possible distance from each other. In this way the leading edge of the sheet is clearly reproduced in the CCD-row array, and there is hardly any stray light.

Such a detecting element is positioned on the gripper bridge in such a way that the sheets cover half of the possible measuring range during the paper travel. The signals detected with respect to this position represent the zero position of the paper. While printing, possible variations (ink tackiness, etc.) are detected as a change in position, stored and/or evaluated. The adjustment can e.g. be performed in such a way that, when not printing, a speed of the paper travel of 3000 sheets per hour represents a zero value being measured or a zero position of the paper sheet. This position is to be measured while approximately 50 sheets are printed and then an average is to be taken. Thereafter possible changes in the position occurring during the printing process or when varying the printing parameters (blanket, plate, ink, etc.) are detected and also averaged. The change in position is indicated in the form of a deviation from the desired position, stored and evaluated.

In accordance with an additional feature of the invention, there are provided an electronic system for processing or editing signals to be stored and a mobile data memory, in the cylinder.

In accordance with yet another feature of the invention, the cylinder is an impression cylinder having a gap formed therein, and the electronic system and the mobile data memory are disposed in the gap. In so doing, accessibility is guaranteed. This embodiment permits the collection of information on the position of the paper at different cylinders at varying speeds, as well as its evaluation after the printing process. For this purpose, after completion of the printing process, the mobile data memory is connected to a readout unit which feeds the information to a personal computer for its evaluation. On the basis of this evaluation, it is possible to appropriately vary one or more printing parameters.

In accordance with yet a further feature of the invention, there is provided a rotary transmitting element for supplying signals from the cylinder, and an evaluation unit for receiving the signals from the cylinder.

In accordance with a concomitant feature of the invention, there is provided a device connected to the evaluation unit for adjusting a paper position. It is conceivable to directly connect the evaluation device to a CPC Tronic unit of a printing machine manufactured by the firm Heidelberger Druckmaschinen Aktiengesellschaft of Heidelberg, Federal Republic of Germany, for the purpose of adjusting the position of the paper.

Other features which are considered as characteristic for the invention are set forth in the appended claims.

Although the invention is illustrated and described herein as embodied in an electric or electronic sheet control device for sheet-transferring cylinders of printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
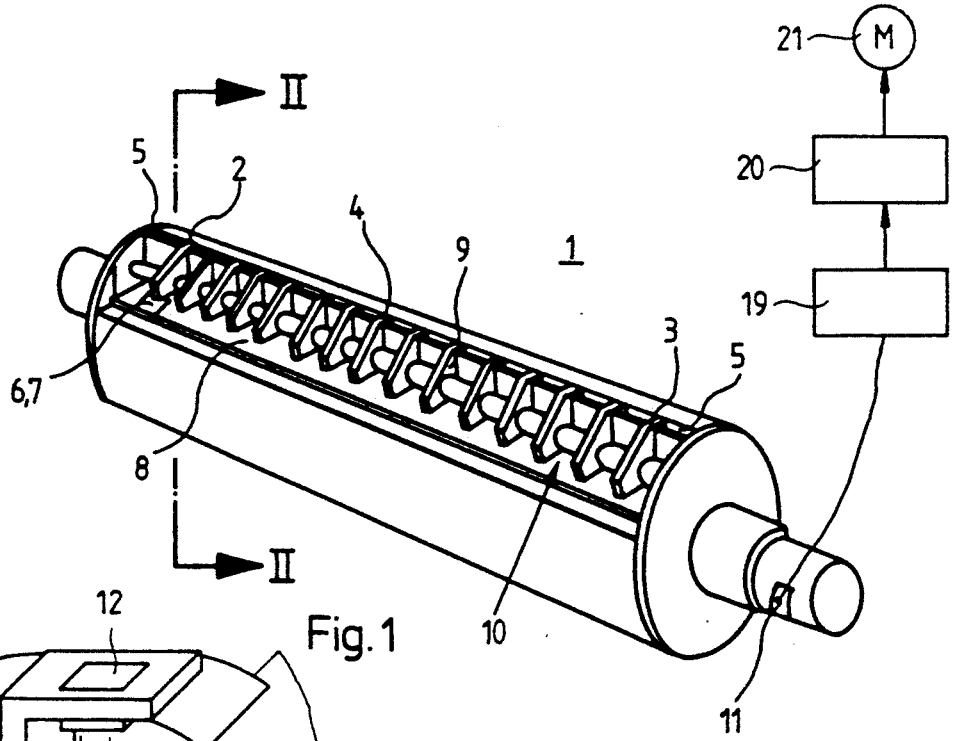
FIG. 1 is diagrammatic, perspective view configuration of elements of a sheet control device provided at a cylinder along with a block circuit diagram.

Referring now to the figures of the drawing in detail and first, particularly, to FIG. 1 thereof, there is seen a cylinder 1 including a gripper bridge 10 being formed of a plurality of grippers 9. The gripper bridge is provided in a gap 8 of an impression cylinder. Two detecting elements 2 and 3 are disposed in such a way that they detect outer areas of a leading edge of the sheet. For this purpose, the two detecting elements are disposed in the vicinity of a cylinder edge 5 cooperating with the gripper. The detecting elements 2, 3 are preferably at a holding surface of a gripper 9 and a corresponding surface of the cylinder edge 5 cooperating with the gripper. A further detecting element 4 is provided between these two detecting elements 2 and 3 in the middle of a sheet to be detected. In so doing, it is possible to detect whether or not the leading edge of the sheet runs parallel to the cylinder axis and whether or not the leading edge of the sheet is straight. The values that are measured may be supplied from the cylinder 1 by means of a rotary transmitting element 11 and may be supplied to an evaluation unit or may be maintained in an available condition by means of an electronic system 6 and a mobile data memory 7 for an inquiry during standstill of the cylinder.

Figure 2:
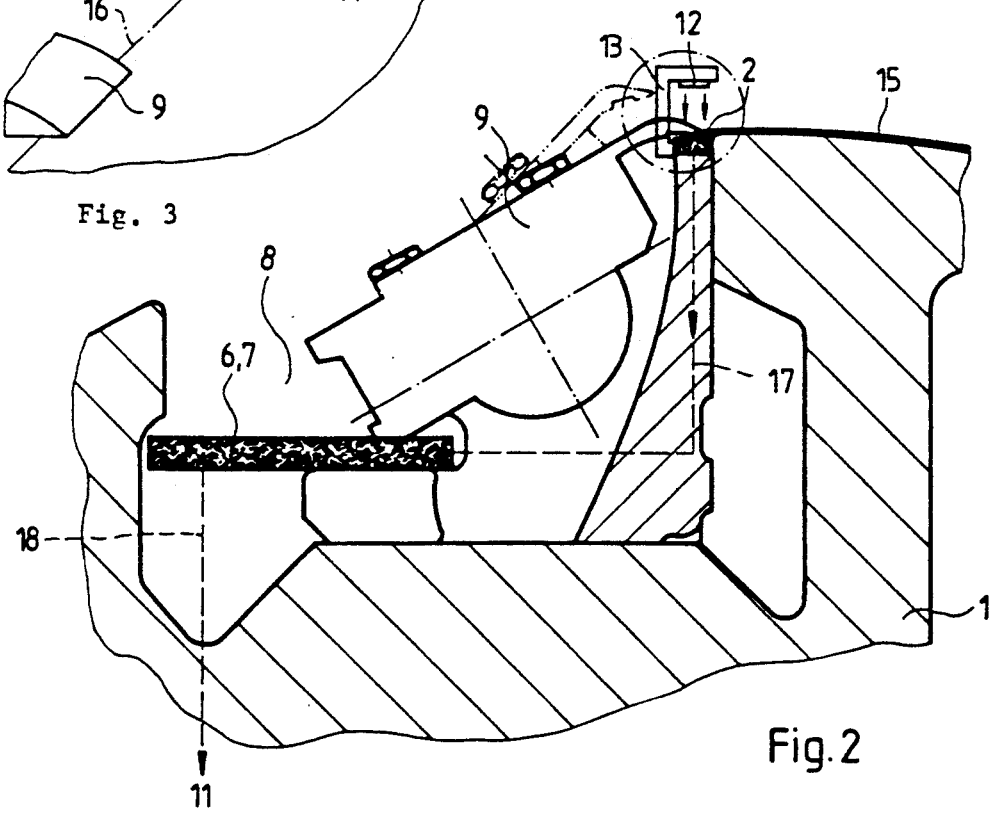
FIG. 2 is a sectional view taken along the line II—II of FIG. 1, in the direction of the arrows.

FIG. 2 is a fragmentary, sectional view taken along the line II—II of FIG. 1 in the vicinity of the detecting element 2. In this exemplary embodiment, one of two parts forming the detecting element is located below the holding surface of the gripper 9. The electronic system 6 which transforms the measured values that have been detected by the detecting elements into storable data and the mobile data memory 7, are provided in the gap 8 of the impression cylinder. Of course, it is also conceivable to provide the electronic system 6 and the data memory 7 at any other place on the cylinder 1. The advantage of providing the configuration in the gap 8 of the impression cylinder is its easy accessibility.

Figure 3:
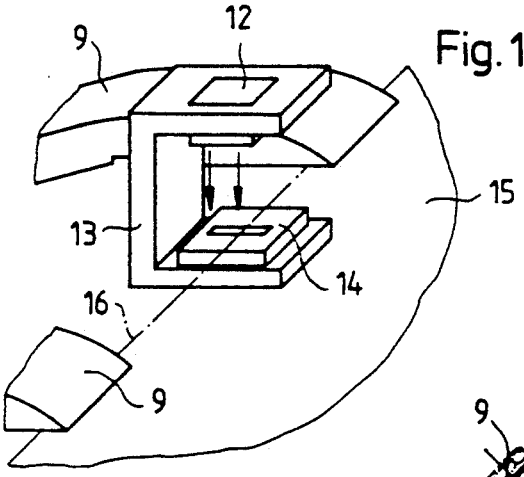
FIG. 3 is an enlarged, fragmentary, perspective view of the portion III of FIG. 2.

As seen in FIGS. 2 and 3, a light source 12 which is secured to a retainer 13 transmits light in the direction of a CCD array 14. It can be seen in the enlarged illustration of FIG. 3 that the CCD array is oriented in such a way that a sheet 15, which is retained at an edge 16 thereof in the grippers 9, shades a portion of the light originating in the light source 12. Depending on the location of the edge 16 of the sheet, more or less pixels of the CCD array 14 are illuminated.

Signals from the CCD array 14 are delivered over a line 17 to the electronic system 6, which includes the memory 7. Measured values for the location of the edge 16 of the sheet 15 can be supplied over a further line 18 from the rotary transmitting element 11 to a stationary evaluation unit 19. The evaluation unit 19 is in communication with a schematically illustrated device 20 for adjusting the paper position. The device 20 is located in the feeder of a non-illustrated printing press, where the sheets 15 are put into a position for transfer by the grippers 9. In this position, the sheets rest against a stop, whose location can be varied with a motor 21.

We claim:

1. In a printing machine having a sheet-transferring cylinder with grippers and a cylinder edge cooperating with the grippers, an electric or electronic sheet control device for the sheet-transferring cylinder, comprising two detecting elements disposed on the cylinder in the vicinity of the cylinder edge for detecting outer areas of the leading edge of a sheet, and at least one further detecting element disposed between said two detecting elements, and including an electronic system for processing signals to be stored and a mobile data memory, both being disposed in the cylinder and connected to said detecting elements.

2. The sheet control device according to claim 1, wherein said at least one further detecting element is disposed on the cylinder at a location corresponding substantially to the middle of the leading edge of the sheet.

3. The sheet control device according to claim 1, wherein said detecting elements are CCD-row arrays.

4. The sheet control device according to claim 3, wherein the grippers have holding surfaces, the cylinder edge cooperating with the grippers has respective surfaces corresponding to said holding surfaces, and including light sources, said light sources being disposed at the holding surfaces of said grippers, and said CCD-row arrays being disposed at said corresponding surfaces.

5. The sheet control device according to claim 1, wherein the cylinder is an impression cylinder having a gap formed therein, and said electronic system and said mobile data memory are disposed in said gap.

6. The sheet control device according to claim 1, including a rotary transmitting element mounted on the cylinder and connected to said electronic system for supplying signals from the cylinder.

7. The sheet control device according to claim 6, including a stationary evaluation unit located away from the cylinder for receiving the signals from the cylinder via said rotary transmitting element.

8. The sheet control device according to claim 7, including a device connected to said evaluation unit for adjusting a paper position.

* * * * *